United States Patent [19]

Gilbert

[11] 4,251,106

[45] Feb. 17, 1981

[54] COLLAPSIBLE LOUNGING CHAIR

[76] Inventor: Bruno J. Gilbert, 281 Kenmore St., Glasgow G41 2QX, Scotland

[21] Appl. No.: 71,254

[22] Filed: Aug. 30, 1979

[51] Int. Cl.[3] ..... A47C 4/00; A47C 5/10

[52] U.S. Cl. ..... 297/18; 297/441; 297/457; 297/440

[58] Field of Search ..... 297/18, 17, 440, 441, 297/457

[56] References Cited

U.S. PATENT DOCUMENTS

| | | | |
|---|---|---|---|
| 547,778 | 10/1895 | Frantz | 297/18 |
| 1,969,313 | 8/1934 | Meeker | 297/18 X |
| 2,689,603 | 9/1954 | Smith | 297/441 X |
| 2,712,349 | 7/1955 | LeVoir | 297/457 X |
| 3,695,702 | 10/1972 | Ingellis | 297/441 |
| 4,047,752 | 9/1977 | Rohr | 297/441 |
| 4,148,520 | 4/1979 | Miller | 297/441 |

*Primary Examiner*—Francis K. Zugel

*Attorney, Agent, or Firm*—Fisher, Christen & Sabol

[57] ABSTRACT

A lounging chair consists of nine tubular members, two pairs of foot supports, a flexible seat and back web and three specially shaped holders for connecting the tubular members together to form two interengaging frames between which the seat and back web is assembled. The two frames are arranged so that when tilted backward and forward a rocking motion is simulated. The individual tubular members and other parts can be quickly assembled for use, or disassembled for carrying in a small bag.

9 Claims, 12 Drawing Figures

FIG. 7
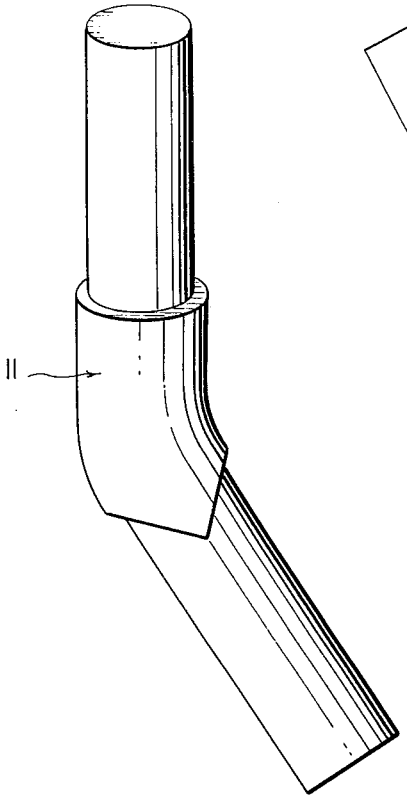
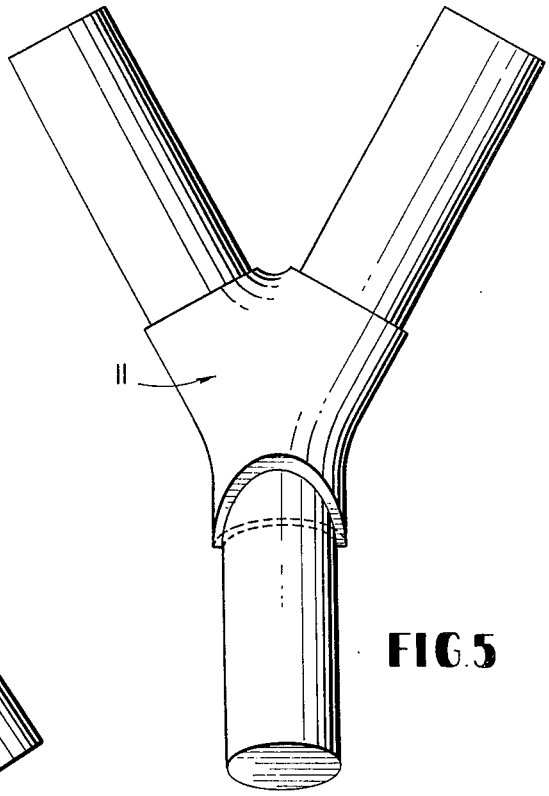
FIG. 5
FIG. 8
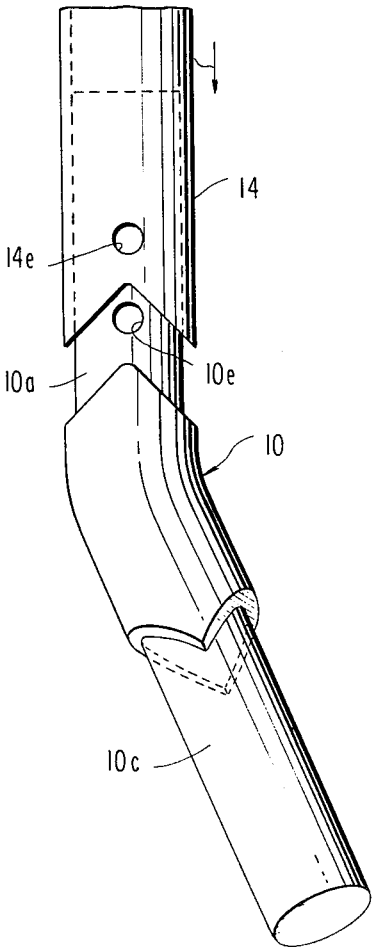
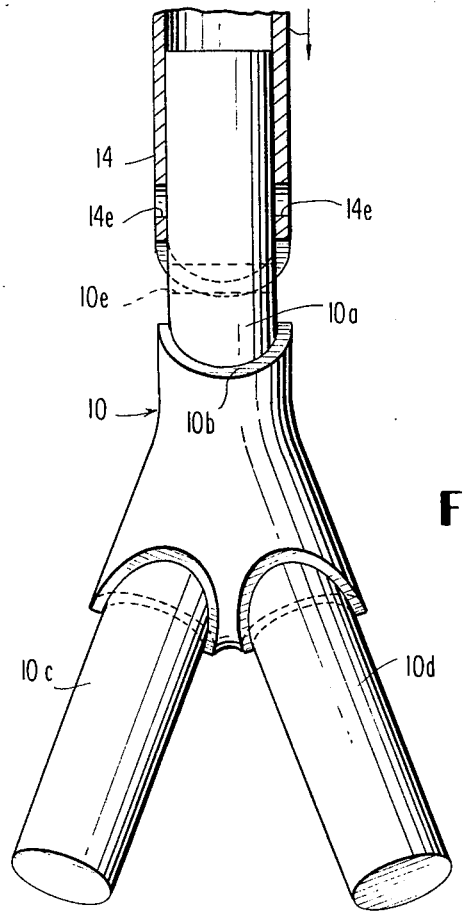
FIG. 6

COLLAPSIBLE LOUNGING CHAIR

BACKGROUND OF THE INVENTION

This invention relates to furniture, and more particularly to a collapsible lounging chair in which the seat and back comprise a flexible web of sheet material, such as fabric, plastic or leather suspended between sections of framework supported on the ground.

Chairs of this general type are shown in U.S. Pat. Nos. 1,481,521; 2,473,090 and 2,689,603; British Patent No. 941,530 and French Patent No. 582,829. However, in all of these chairs, complex arrangements of hinges and pivoting elements are required to convert the chair from its collapsed condition to its open position for use, and vice versa.

U.S. Pat. Nos. 4,118,064 and 4,148,520 and French Patent No. 1,233,310 discloses lounging chairs in which the framework can be assembled and disassembled into its constituent elements for carrying. The first of these is constructed of wood pieces which must be carefully fabricated in order to ensure correct assembly and would be comparatively; the latter two are assembled from tubular elements of light weight but of flimsy construction.

SUMMARY OF THE INVENTION

It is an object of this invention to provide a light weight lounging chair which is fabricated from load bearing struts which can be quickly assembled for use and disassembled for carrying and is sturdy when in use.

Another object is to provide a lounging chair comprising two relatively movable frames which suspend the seat between them and when tilted in backward and forward directions provide a simulated rocking motion.

BRIEF DESCRIPTION OF THE DRAWINGS

FIGS. 5 and 6 are front views of two connectors;

FIGS. 7 and 8 are side views of the same;

DESCRIPTION OF THE PREFERRED EMBODIMENT

Figure 3A:
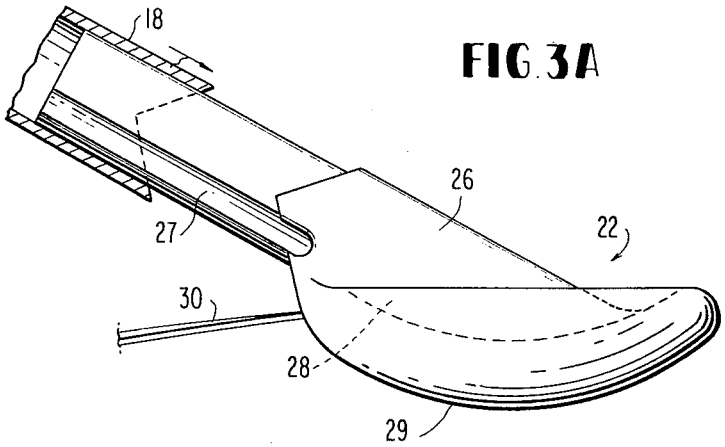
FIG. 3A is a side view of the footpad.
Figure 3C:
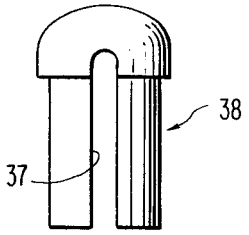
FIG. 3 is a side view on an enlarged scale of a footpad.
FIG. 3B is a side elevation of a plug for attaching the seat and back web to the frame.

As can be seen from the drawings the chair comprises two interacting frames which can be assembled and disassembled from tubular elements connected by specially formed connector elements so that a flexible web can be suspended between the upper extremities of the two frames.

The first frame includes a pair of connector members 10 and 11, each having three pegs for detachably receiving tubular members in a Y-shaped array. The tubular members 12 and 13, slipped upon the lower pegs of connector 10 form an inverted, downwardly and forwardly tilted V comprising the front legs of the chair. The tubular member 14 forms an upwardly projecting extension and is detachably received on one of the pegs of the connector member 11. Two other tubular members 15 and 16 are detachably inserted into the upper openings in socket 11 to define a generally upright V.

The second frame comprises a connector member 17 provided with four tube-receiving pegs. Tubular members 18 and 19, having their upper ends detachably received on the connector 17 define a downwardly and rearwardly tilted inverted V-shaped structure forming the rear legs of the chair. The upper pegs on the connector detachably receive the lower ends of the tubular members 20 and 21 which diverge outwardly and upwardly so that, together with members 18 and 19, the second frame generally is X-shaped.

Figure 3B:
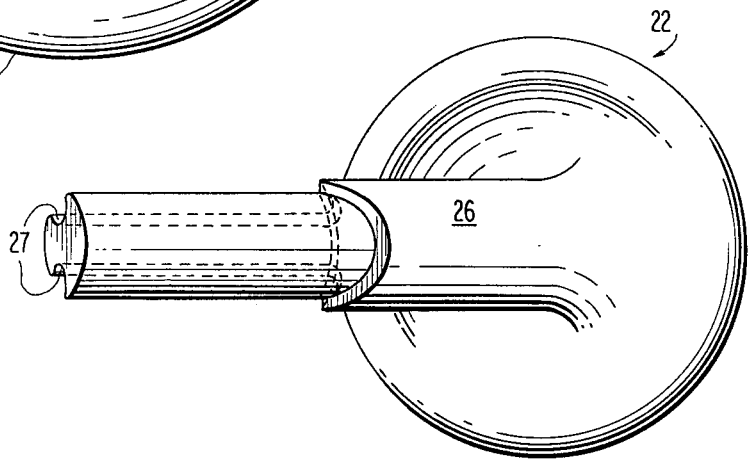

Two pairs of generally disc-shaped footpads 22, 23 and 24, 25 are provided in their upper portions with angularly directed pegs so that when the lower ends of the legs 12, 13, 18 and 19 are detachably inserted thereon the pads will be substantially in a horizontal plane. FIGS. 3A and 3B illustrate the construction of one pad 22, which may be molded, or cast, to provide the upwardly angled peg 26 on which the leg 18 is inserted. In this connection it should be noted that a portion of the lower end of tube 18 may be provided with inwardly deformed longitudinal flutes and the exterior of the peg is formed with complementary longitudinal grooves 27 which mate with the flutes to prevent twisting of the pad when in place. Preferably, the lower portion of the pad is provided with a semispherical surface 29, for a purpose which will be explained. Although only one pad has been described in detail all of them are similarly formed. In addition, the pair of pads 22 and 23, and the pair 24 and 25 are each joined together by respective flexible straps, or cables, 30 which may have their ends molded in place or otherwise secured to the pads so that when the pads are in place they will confine the front and rearward displacement of the lower ends of the two frames to prevent collapse of the chair.

Figure 4:
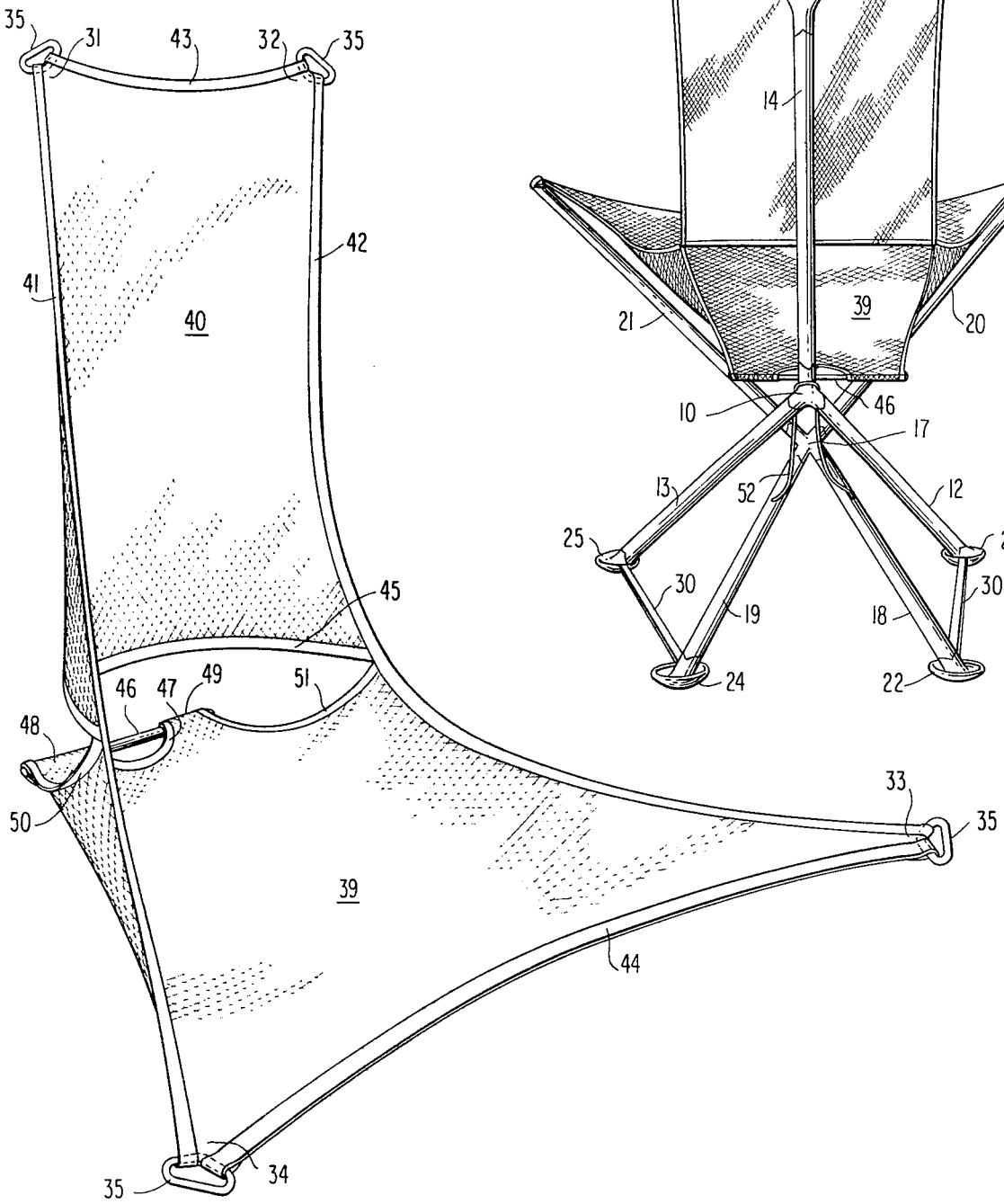
FIG. 4 is a perspective view of the seat and back web.
Figure 9:
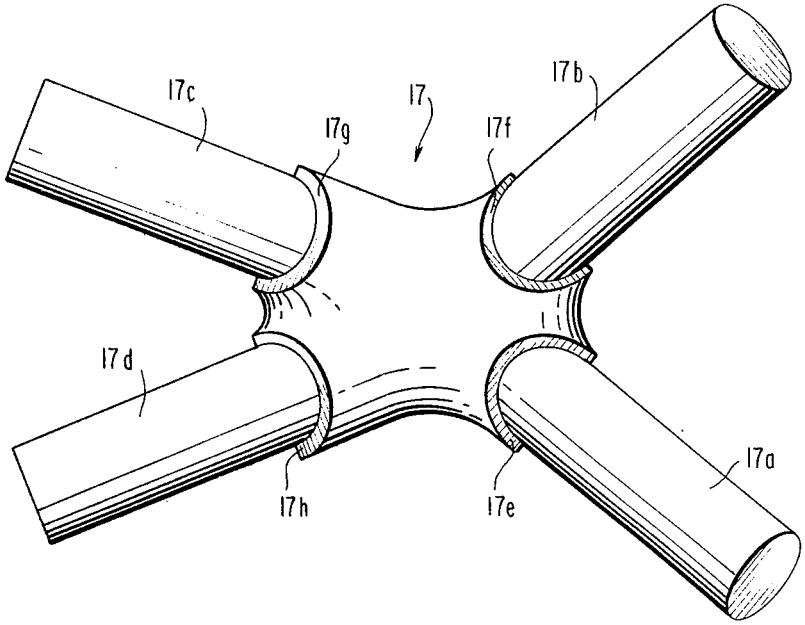
FIG. 9 is a plan view of another connector.

As shown in FIG. 4, the seat on back is formed from flexible sheet material, which may be a plastic mesh, or could be canvas, fabric, or leather or similar material and is elongated to provide four corners 31, 32, 33 and 34 which are respectively detachably secured to the upper extremities of tubular members 15, 16, 21 and 20 by means of D-shaped metal rings 35. The straight portions of each ring fits within the longitudinal slot 37 of a molded plug 38 which can be inserted into the end of each tube.

The seat portion 39 and the back portion 40, of the flexible web can be formed from a single sheet of material but preferably two pieces are used with the side margins joined to a pair of reinforcing bindings 41 and 42 of fabric or heavy cord attached at the upper and lower ends to the appropriate D-rings 35 so that the seat and back are suspended between the upper ends of the two frames. Similar heavy cords, or bindings, 43 and 44 are secured to the top and front margins and, in addition are attached to D-rings 35 to assist in preventing transverse spreading of members 15, 16 and 20, 21. The lower end of the back 40 may also be provided with a marginal binding, or cord, 45 which extends between medial points of the cords 41 and 42.

The rear portion of the seat 39 may extend rearwardly behind the plane of the back 40 to provide orthopaedic support, and is supported by a horizontal rubber-coated metal rod 46 which is detachably secured to tubular member 14, such as by a hook, or clamp. The center of fabric is cut out at 47 so that, if desired the rod 46 can be secured in a place behind member 14, or passed through aligned openings in tubes 13 and 14 and connector 10 whereby it performs the additional function of securing the various elements together. The marginal portions 48 and 49 of the seat are securely wrapped around the ends of the rod and binding cords 50 and 51 extend between the ends of rod 46 and the two cords 41 and 42 to give support to the rear side margins of seat 39.

Figure 1:
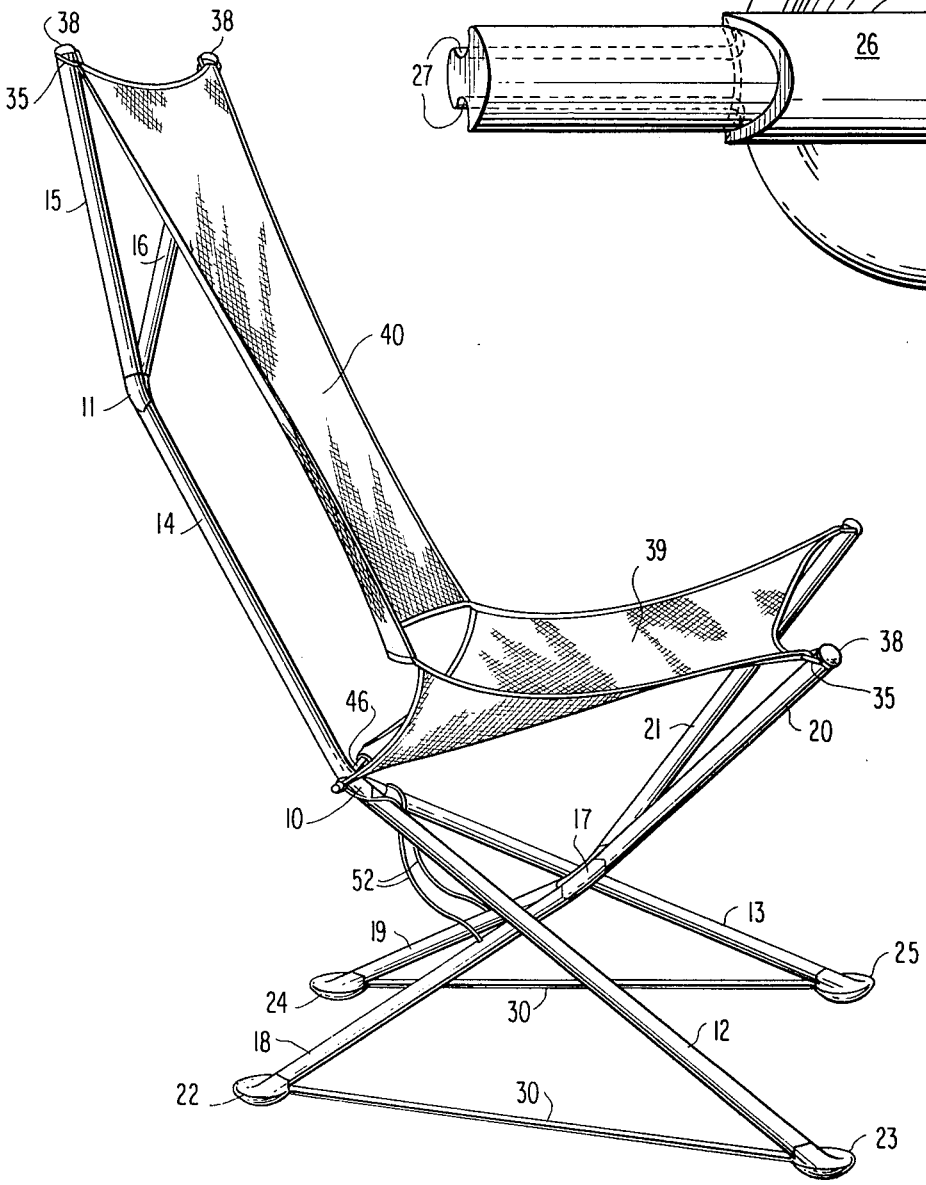
FIG. 1 is a side elevation of a preferred form of lounging chair constructed in accordance with this invention.
Figure 2:
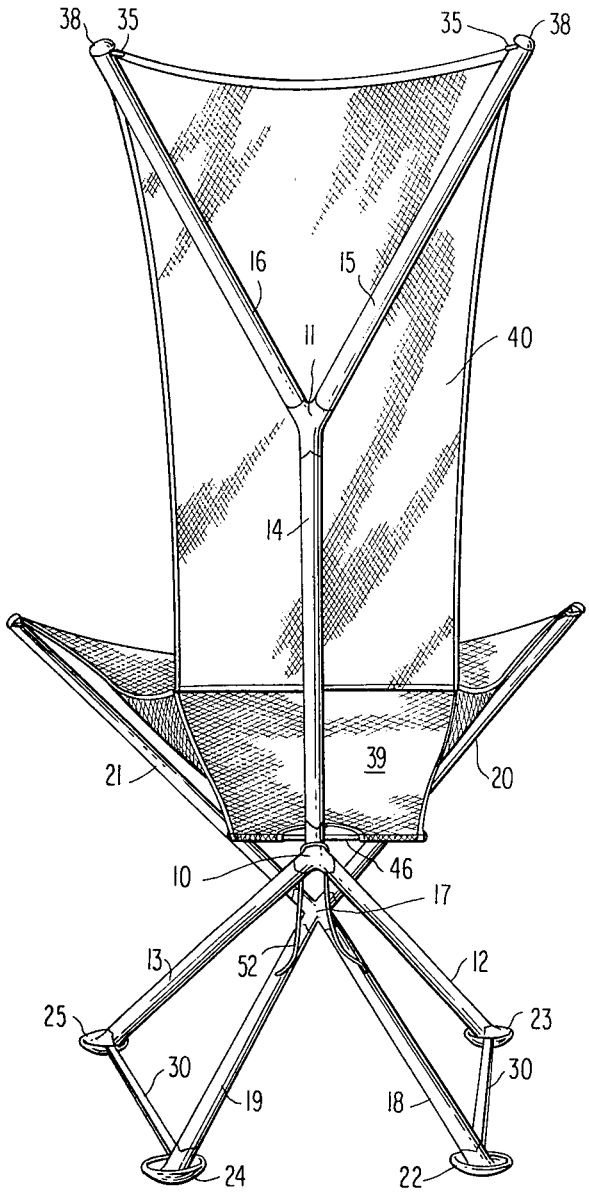
FIG. 2 is a rear elevation of the same.

In use, the occupant of the chair can simulate the motion of a rocking chair, due to the fact that the two frames are not rigidly connected to each other at any point and can swing backwardly and forwardly, as indicated by the broken lines in FIG. 1, which swinging movement is facilitated by the semispherical lower surfaces 29 of each of the footpads 22, 23, 24 and 25. Since the tubular members 12 and 13 overlie the members 18 and 19, this movement in a rearward direction will be limited by contact between them at a certain point, and movement in a forward direction may be controlled by a cord, or cable, 52 extending between socket 10 and the members 18 and 19.

A detailed view of the connectors is shown in FIGS. 5–10 in which it can be seen that the downwardly projecting pegs 10A and 10B of connector 10 are provided with bevelled outwardly directed flanges 10C and 10D, which coact with the mitered end margins of the tubes supported by the pegs as for example the end margin of 12C of tubular member 12 which is shown partially in place in FIG. 8. This also prevents relative rotation of the tube with respect to the connector and contributes to the stability of the chair. The openings 12E in the tube 12 are aligned with openings 10E of the peg 10A to receive the rod 46 as previously described.

Figure 10:
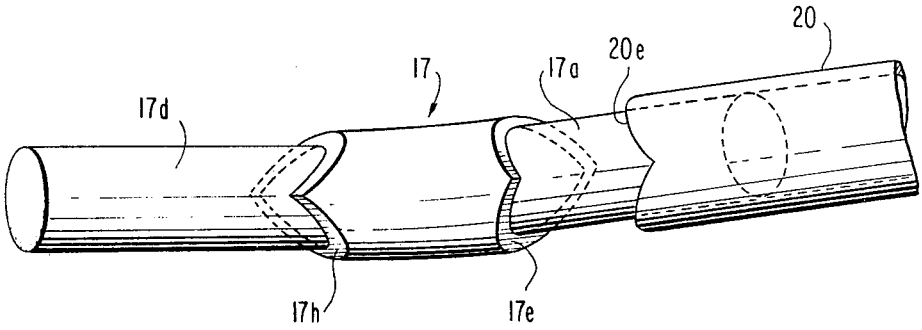
FIG. 10 is a side view of the same.

Similarly, the four pegs 17A, 17B, 17C and 17D may each be provided at their bases with respective outwardly projecting bevelled flanges 17E, 17F, 17G and 17H. Each of the tubular members 18, 19, 20 and 21 may also be provided with mitered end margins, as for example 20E as shown in FIG. 10, to prevent relative turning of the tubular members with respect to connector 17 which ensures stability for the chair as a whole.

Finally, it should be noted the chair is uniquely adapted for travelling because it may be disassembled into its component parts consisting of nine tubular members, two Y-sockets, and X-socket, two pairs of footpads and a flexible seat and back. All of the elements can be rolled together in the fabric and carried in a bag, or other container less than two and a half feet long and eight inches, approximately, in diameter.

I claim:

1. In a lounging chair, the combination including a first tubular frame means having an inverted V-shaped portion at one end, the free ends of the inverted V-shaped portion defining the front legs, an X-shaped second tubular frame means, two of the tubular elements of the second frame means defining the rear legs, an elongated web of flexible sheet material forming the seat and back of the chair, the X-shaped frame means being downwardly and rearwardly tilted, means to detachably secure one end of the web to the upwardly projecting ends of the X-shaped frame means, the apex of the inverted V-shaped portion of the first frame means being disposed above the medial portion of the X-shaped frame means and the tubular elements of the inverted V straddling the tubular elements of the X-shaped frame means and being downwardly and forwardly tilted to define the front legs, the first frame means also including a back supporting extension projecting upwardly from the apex of the V-shaped portion, means to detachably secure a medial portion of said web to the first frame means adjacent said apex to define the seat, means to detachably secure the other end of the web to said extension to define the back, and means to connect the extremities of the front legs to the extremities of the rear legs to prevent collapse of the chair and to permit limited tilting of both said frame means to provide simulated rocking motion by the occupant of the chair.

2. Lounging chair of claim 1, wherein the extension of said first frame means terminates in an upright v shaped portion, and means to secure the opposite corners of the web to the free ends of the upright V shaped portion.

3. Lounging chair of claim 1, which includes means to restrict forward tilting of both said frame means.

4. Lounging chair of claim 3, wherein said means to restrict tilting comprises a flexible cable or strap connected between the first and second frame means.

5. Lounging chair of any one of claims 1, 2, 3 or 4, wherein said means to secure a mid portion of the web comprises a horizontal bar, and means to detachable connect the bar to the first frame means.

6. Lounging chair of claim 5, wherein said first frame means includes a single tubular member projecting upwardly from the apex of the inverted V shaped portion.

7. Lounging chair of claim 5, wherein said means to restrain to prevent collapse of the chair comprises two pairs of foot members, the two foot members of each pair being joined together by a flexible strap means, each of the foot members being provided with a socket to receive a lower extremity of one of the frame means and having a hemispherical lower surface to facilitate said rocking motion.

8. Lounging chair of claim 1, which comprises:

nine tubular members;

two connector members provided with three pegs to detachably receive the ends of three tubular members in a Y shaped configuration;

one connector member provided with four pegs to detachably receive the ends of four tubular members in an X shaped configuration;

a flexible seat and back web having four corners, and means to detachably connect the four corners to the ends of four tubular members, and;

four footpad members to be detachably secured to the ends of four other tubular members.

9. Lounging chair as defined in claim 8, wherein said means to connect the four corners of said web comprise a metal ring attached at each corner and four molded plugs having a slotted portion to accept a respective ring therein and in turn to be inserted into the upstanding end of a tubular member.

* * * * *